US006814161B1

(12) United States Patent
Draney et al.

(10) Patent No.: US 6,814,161 B1
(45) Date of Patent: Nov. 9, 2004

(54) STAKEDOWN ASSEMBLY FOR A HORIZONTAL DIRECTIONAL DRILL

(75) Inventors: Robert G. Draney, Derby, KS (US); Donald C. Sassor, Osceola, WI (US); Jeffrey S. Volden, Burlington, IA (US)

(73) Assignee: Case Corporation, Racine, WI (US)

( * ) Notice: Subject to any disclaimer, the term of this patent is extended or adjusted under 35 U.S.C. 154(b) by 0 days.

(21) Appl. No.: 09/501,875

(22) Filed: Feb. 10, 2000

(51) Int. Cl.[7] ..... E21B 11/02

(52) U.S. Cl. ..... 175/19; 175/220; 175/113; 175/162; 175/195; 175/202; 175/203

(58) Field of Search ..... 175/19, 52, 73, 175/85, 113, 122, 162, 170, 195, 202, 203, 220

(56) References Cited

U.S. PATENT DOCUMENTS 4,953,638 A * 9/1990 Dunn
5,148,880 A * 9/1992 Lee et al.
5,709,276 A * 1/1998 Lee
6,216,797 B1 * 4/2001 Dravey et al.

* cited by examiner

*Primary Examiner*—Roger Schoeppel
(74) *Attorney, Agent, or Firm*—Richard G. Lione; Brinks Hofer Gilson & Lione

(57) ABSTRACT

A stakedown assembly for a horizontal directional drill that multiplies the travel of a hydraulic cylinder so that the drive head travels twice the distance of the hydraulic cylinder travel. A gear pinion is pivotally attached to a top end of the hydraulic cylinder. A first gear rack is fixedly attached to a tower, and a second gear rack is fixedly attached to a drive head. The gear pinion floats between the two gear racks, thus, producing multiplication when the hydraulic cylinder is actuated. This allows the use of a shorter hydraulic cylinder and results in a smaller overall stakedown assembly height.

13 Claims, 3 Drawing Sheets

STAKEDOWN ASSEMBLY FOR A HORIZONTAL DIRECTIONAL DRILL

FIELD OF THE INVENTION

The present invention relates generally to horizontal directional drill machines. It relates particularly to a stakedown assembly for a horizontal directional drill machine.

BACKGROUND OF THE INVENTION

A horizontal directional drill machine is a common and well-known machine for installing pipes beneath the ground and generally parallel to the surface. These machines are used in many different applications and are available in a wide range of sizes. Typical applications where a horizontal directional drill machine might be used include the installation of fiber optic cables, electrical cables, gas lines, water systems, or sewer systems. Horizontal directional drill machines are commonly rated in terms of pull-back capacity. Some machines for smaller applications have as little as five thousand pounds of pull-back capacity. Other machines are available with a pull-back capacity of as much as one million pounds of pull.

One alternative to a horizontal directional drill machine is the traditional trencher machine. A trencher machine simply digs a trench into the ground, and after (for example) pipe is laid down in the bottom of the trench, the trench is filled and the pipe is buried. The advantage of a horizontal directional drill machine over a trenching machine is that a pipe can be buried in the ground over long distances without digging a trench. Thus, a horizontal directional drill is particularly desirable when a trench would be difficult or too costly to dig. For example, a horizontal directional drill machine finds particularly advantageous application for installing pipes under roadways, where destruction of the road is expensive and inconvenient to travelers, or under a waterway like a river, where trenching would be impossible.

A unique aspect of a horizontal directional drill machine is the special drill head that is attached to the front end of a pipe to be laid. The drill head has an angled shape which allows the operator to change the direction of the pipe after it has entered the ground. Direction changes are achieved by stopping the pipe and drill head rotation and orienting the drill head at a desired angle. Then, by pushing on the drill pipe without rotating it, the drill head and attached pipe will veer in the desired direction. Thus, by effecting directional changes to pipe travel, a pipe might enter the ground at an angle, travel horizontally over a long distance, and re-exit the ground at another angle. This ability to steer the direction of pipe travel also allows the operator to steer the pipe around underground obstacles like boulders.

In addition to pushing forces that must be applied to the pipe as it is inserted, it is often necessary to pull back on the pipe. This may be necessary when a direction change is not completely successful on the first attempt, or when an underground obstacle like a boulder is encountered. The machine then pulls the pipe and drill head back to permit a direction change.

The push and pull forces that are a horizontal drill machine must apply to the drill pipe frequently exceed the weight of the machine itself. Therefore, a system is required to anchor the machine and resist these large forces. The most common system for anchoring the drill machine comprises the use of stakes mounted on the machine body which are screwed into the ground. The stakes have fighting on their tips and are driven into the ground by applying simultaneous rotational and vertical forces to each stake. To drive and remove these stakes, a shakedown assembly is conventionally provided on the end of the drill machine where the drill head enters the ground.

The stakedown assembly includes a drive head that applies the rotational and vertical forces necessary to install the stakes into the ground. A common method of providing vertical force to the drive head is the use of a hydraulic cylinder. Typically, the hydraulic cylinder is pivotally connected at its bottom end to a fixed point on the stakedown assembly. The top end of the hydraulic cylinder is pivotally attached to the drive head which is able to slide longitudinally along a tower. Thus, by operating the hydraulic cylinder, the drive head travels up and down the tower as desired.

Stakes are commonly driven into the ground to a depth of about three feet for optimal holding strength. The drive head, therefore, must be designed to supply this amount of vertical travel. With the type of drive head previously described, a long hydraulic cylinder with a travel length matching the desired stake depth must be provided along with a tall tower and drive head to accommodate the full travel. Because of the overall height of this type of stakedown assembly, which can become quite tall, it is desirable to have a stakedown assembly that could provide the necessary vertical travel distance to the stake but with a smaller overall height.

BRIEF SUMMARY OF THE INVENTION

It is an object of the invention to provide a stakedown assembly which multiplies the travel distance of the hydraulic drive cylinder so that the drive head travels twice the distance of the hydraulic cylinder.

According to the invention, the bottom end of the hydraulic cylinder is pivotally attached to a tower at a fixed connection point along the bottom side of the tower. A gear pinion is pivotally attached to the top end of the hydraulic cylinder with a pivot shaft and a clevis. A first gear rack is fixedly attached to the tower, and a second gear rack is fixedly attached to the drive head. The gear pinion floats between the two gear racks, and when the hydraulic cylinder is actuated, the drive head travels twice the distance of the cylinder. Therefore, a shorter travel hydraulic cylinder is required, and the overall height of the stakedown assembly can be smaller. To maintain proper distance between the gear racks, rollers are pivotally attached to the drive head and contact the tower along its front side to maintain a minimum allowable distance between the gear racks. Shims are attached to the drive head along the back side of the tower to maintain a maximum allowable distance between the gear racks.

BRIEF DESCRIPTION OF SEVERAL VIEWS OF THE DRAWINGS

The invention, including its construction and method of operation, is illustrated more or less diagrammatically in the drawings, in which.

DETAILED DESCRIPTION OF THE INVENTION

Figure 1:
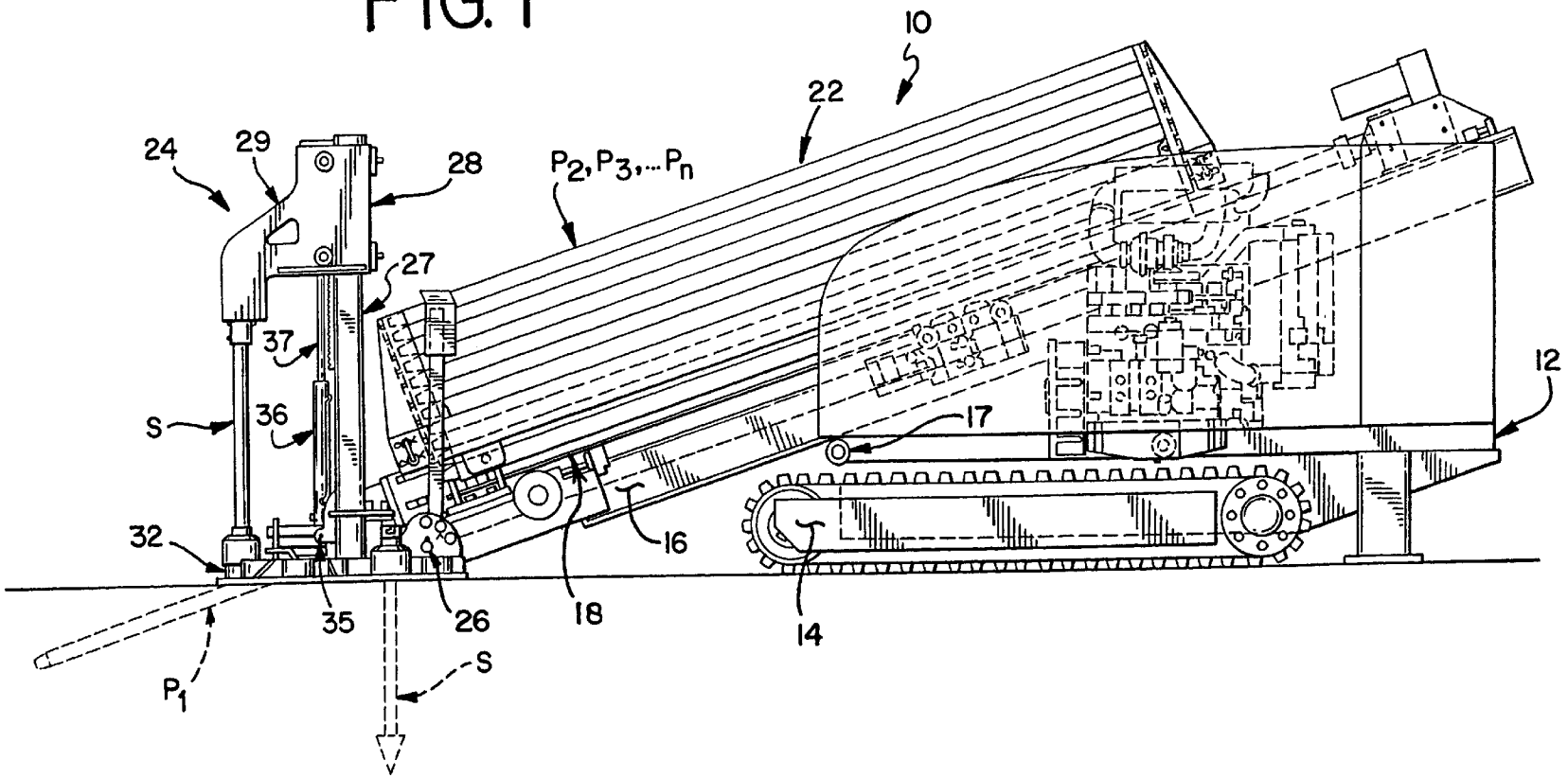
FIG. 1 is a side elevational view of a horizontal directional drill, showing the drill in its operating mode.
Figure 3:
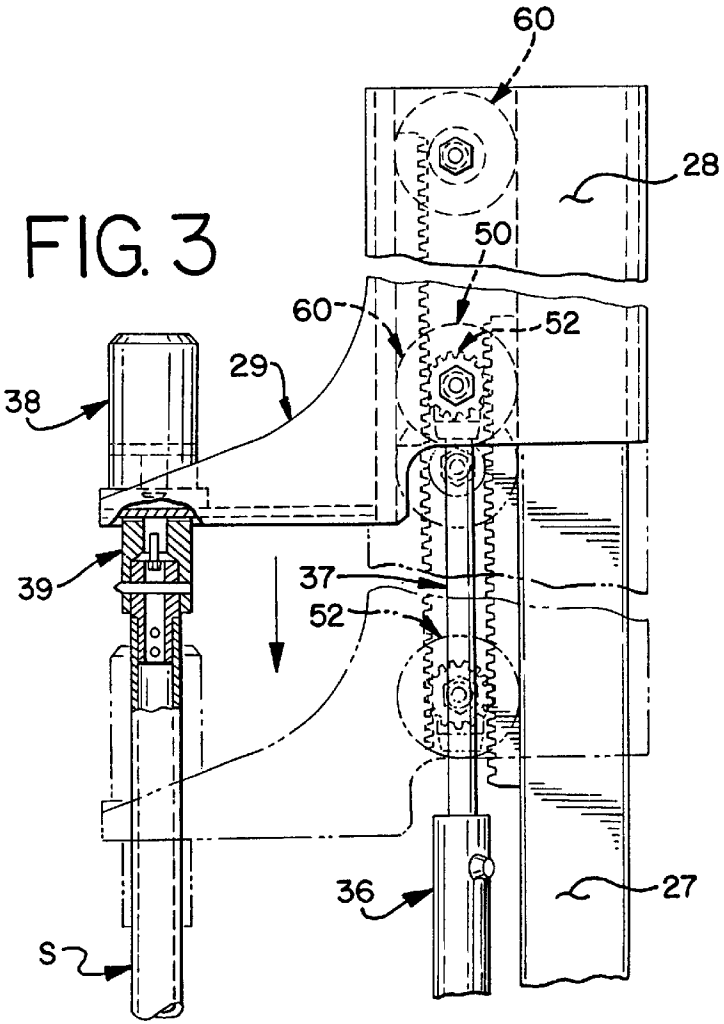
FIG. 3 is a side elevational view of a stakedown assembly, showing the drive head and the upper parts of the tower and hydraulic cylinder.
Figure 2:
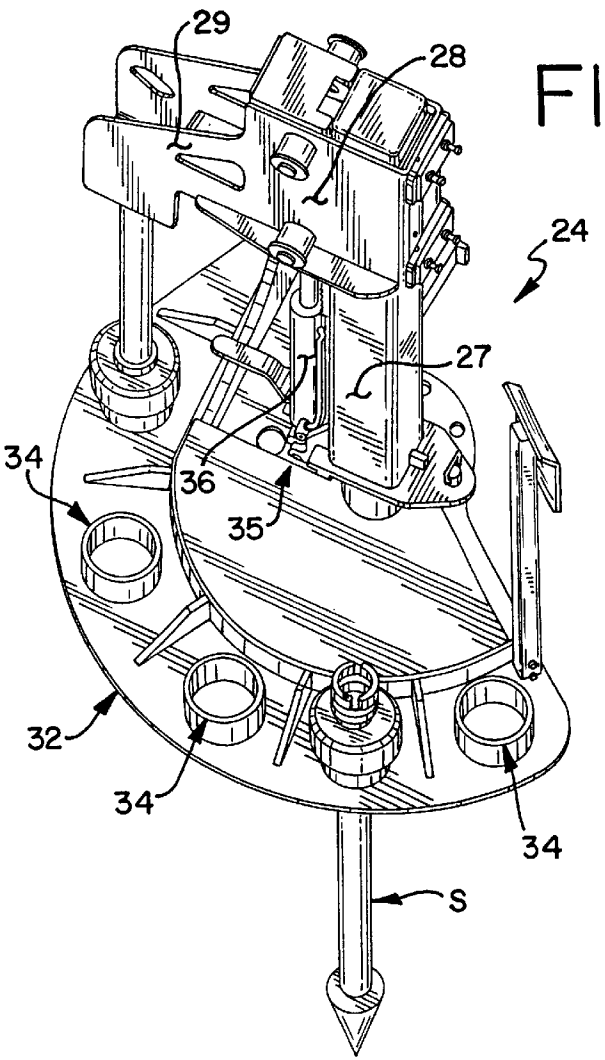
FIG. 2 is a perspective view of a stakedown assembly, with one stake installed into the ground and a second stake positioned under the drive head for installation.
Figure 4:
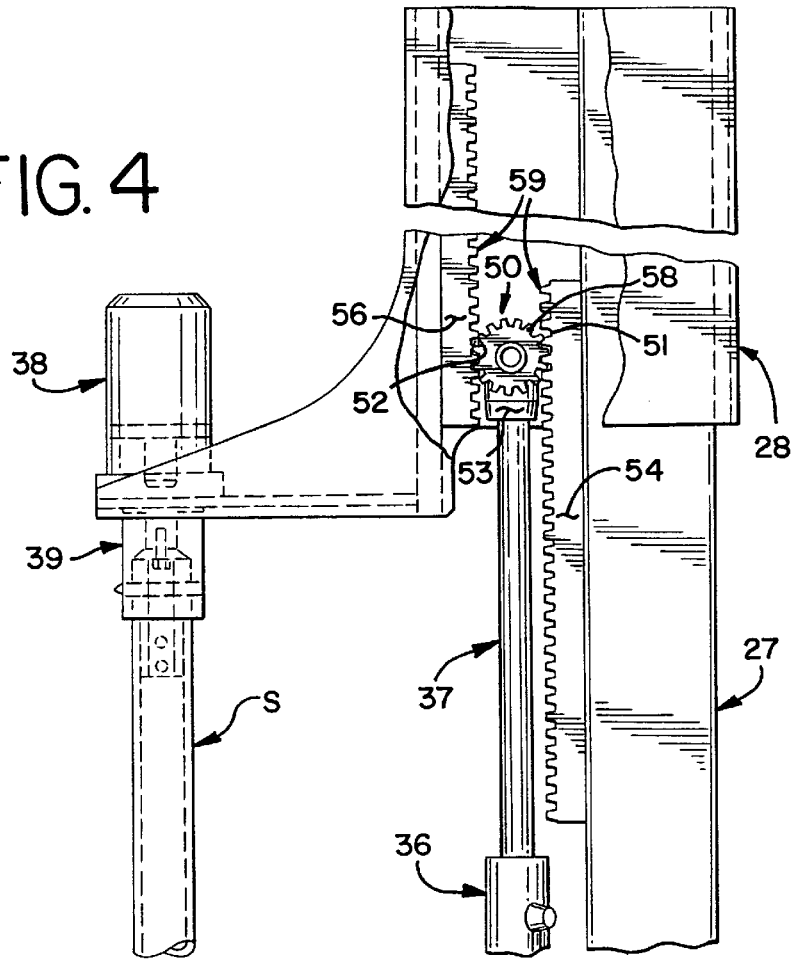
FIG. 4 is a side elevational view of a part of the stakedown assembly, showing a broken away section around the rack and pinion.
Figure 5:
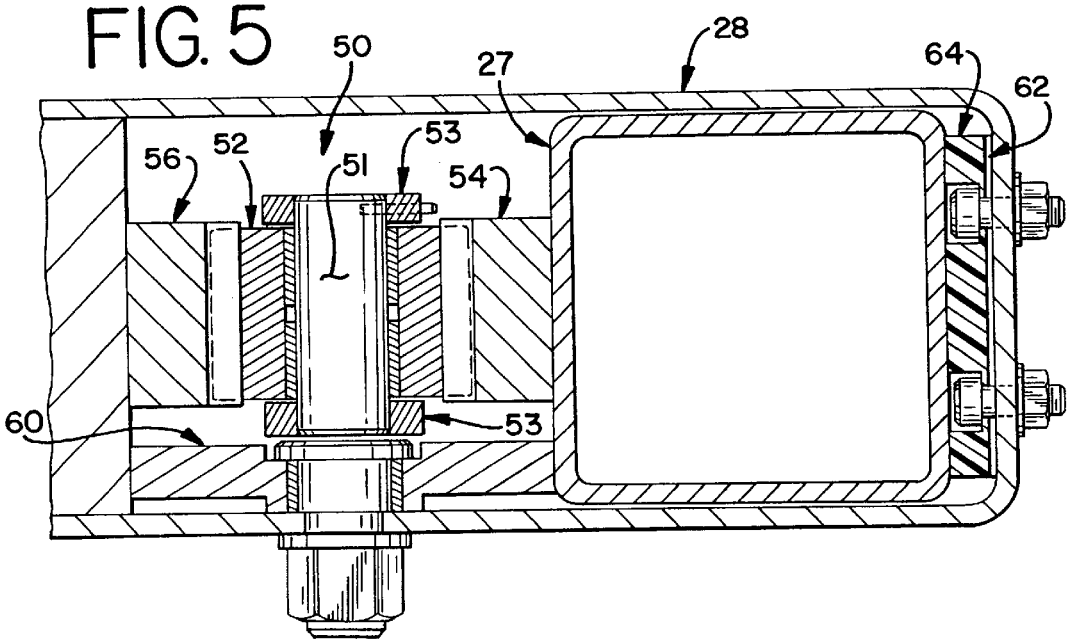
FIG. 5 is a top sectional view of the stakedown assembly, through the center of the gear pinion and showing two gear racks.

Referring now to the drawings, and particularly to FIG. 1, a horizontal directional drill machine is shown generally at 10. The drill machine 10 includes a frame 12 supported by driven tracks 14 for moving the drill machine 10 from place to place.

The drill machine 10 includes a longitudinally elongated boom 16 pivotally mounted on the front end of the frame 12, as at 17. A conventional pipe drill assembly 18 is mounted on the boom 16, extending coextensively therewith. The drill assembly 18 is designed to drill a series of pipe sections $P_1$, $P_2$, $P_3$, et seq., into the ground in sequence.

In the operating mode of the drill machine 10, the boom 16 is pivoted upward away from the frame 12 so that pipe section $P_1$ extends from the drill assembly 18 and intersects the ground at an angle. A special drill head (not shown) is attached to the front end of the first drill pipe section $P_1$. In order to drill the pipe section PI into the ground and make any desired directional changes in its path, a variety of push, pull, and rotational forces are applied to the pipe section $P_1$ by the drill assembly 18. The manner in which the drill assembly 18 applies these forces to the drill pipe section $P_1$ are not described, but are well known to those skilled in the art.

As the first pipe section $P_1$ is drilled into the ground, new pipe sections $P_2$, $P_3$, et seq., are successively attached to the rear end of the preceding pipe sections. A cartridge 22 of pipe sections $P_2$, $P_3$, et seq. is provided on the boom 16 for storing these additional pipe sections, and a semi-automatic or fully automatic loader (not shown) may be provided for attaching them to the preceding pipe sections.

A stakedown assembly 24 is positioned to the front end of the drill machine 10. The stakedown assembly 24 is attached to forward end of the boom 16 at a pivot connection 26, which allows the stakedown assembly 24 to be oriented level with the ground surface when the boom is tilted. A coupling such as described in concurrently filed Draney et al. U.S. patent application Ser. No 09/500,820 filed Feb. 10, 2000, may be provided for quickly and easily connecting the stakedown assembly 24 to the drill machine 10.

Turning now to FIGS. 2 through 5, a multiple position stakedown assembly 24 as described in concurrently filed Draney et al. U.S. patent application Ser. No. 09/503,600, filed Feb. 11, 2000 is shown. The stakedown assembly 24 includes a tower 27 mounted on a base plate 32 for rotation about a vertical axis. Oriented in a segmentally circular pattern at equal distances from the tower 27 are a series of stake locator ports 34 in the base plate 32 through which the stakes S are driven into the ground.

A rotational drive motor 38 is installed on the overhanging portion 29 of the drive head 28 with the drive shaft 39 oriented coaxially with the ports 34. The drive head 28 is slidably mounted on the tower 27 to allow longitudinal movement along the tower 27. By rotating the tower 27, the drive head 28 may be positioned vertically over any one of the ports 34 in order to install a stake S.

According to the present invention, vertical force is applied to the drive head 28 by a hydraulic cylinder 36 acting through a rack and pinion assembly 50. The hydraulic cylinder 36 is pivotally attached on its bottom end to a fixed connecting point 35 at the bottom of the tower 27. Mounted for rotation on the top end of the hydraulic cylinder rod 37 is a gear pinion 52. The gear pinion 52 rotates about a shaft 51 which extends through the center of the pinion 52. A clevis 53 is attached to ends of the shaft 51 which extend beyond the sides of the pinion 52 and to the end of the cylinder rod 37.

Gear teeth 58 are provided around the outer circumference of the gear pinion 52. Two gear racks 54, 56, each with gear teeth 59 matching the gear teeth 58 of the gear pinion 52, are attached to the tower 27 and the drive head 28, respectively. The first gear rack 54 is fixedly attached to the tower 27 so that one side of the pinion 52 engages the rack 54 along an upper end when the drive head 28 is in the raised position. The second gear rack 56 is fixedly attached to the drive head 28 so that the other side of the pinion 52 engages the rack 56 along a lower end when the drive head 28 is raised.

The pinion 52 floats between the two racks 54, 56. When the cylinder 36 is actuated, the drive head 28 travels twice the distance of the hydraulic cylinder rod 37. In the preferred embodiment, the hydraulic cylinder rod 37 has a range of travel of about sixteen inches. Therefore, when the hydraulic cylinder rod 37 is retracted from its fully extended position, the drive head 28 will travel thirty-two inches downward because the rack and pinion assembly 50 multiplies the drive head 28 travel by twice the cylinder 36 travel. Thus, a cylinder 36 of only half the travel length of prior art systems is required. Additionally, because a shorter hydraulic cylinder 36 can be used, the overall height of the stakedown assembly 24 can be reduced.

To maintain proper spacing between the two gear racks 54, 56 during operation, a set of rollers 60 and shims 62 are provided. The rollers 60 are pivotally attached to the drive head 28 so that their axes of rotation are parallel to the axis of the pinion 52. One side of the rollers 60 contact the front side of the tower 27. Thus, when the drive head 28 is actuated up and down, the rollers 60 maintain a minimum allowable distance between the gear racks 54, 56.

A pad 64 of nylon or a similar material is also fixedly attached to the drive head 28 along the back side of the tower 27. Because of the physical properties of the nylon, the pad 64 directly contacts the tower 27 along its back side and provides a sliding surface between the drive head 28 and the tower 27 without resulting in significant wear of either the nylon pad 64 or the metal tower 27. Installed under the nylon pad 64 between the pad 64 and the drive head 28 are shims 62. As will be appreciated by one skilled in the art, the thickness of the shims 62 is appropriately determined to maintain a maximum allowable distance between the gear racks 54, 56.

While a preferred embodiment of the invention has been described, it should be understood that the invention is not so limited, and modifications may be made without departing from the invention. The scope of the invention is defined by the appended claims, and all devices that come within the meaning of the claims, either literally or by equivalence, are intended to be embraced therein.

What is claimed is:

1. A stakedown assembly for driving stakes to anchor a horizontal directional drill comprising:

a) a support member;

b) a fixed rack fixedly attached to said support member;

c) a drive head connected to said support member to allow longitudinal movement thereon;

d) a moving rack fixedly attached to said drive head;

e) a pinion installed between said fixed rack and said moving rack; and f) a drive motor connected to said pinion.

2. The stakedown assembly according to claim 1 wherein the operative range of travel of said pinion is greater than fifteen inches.

3. The stakedown assembly according to claim 1 wherein the operative range of travel of said pinion is less than twenty inches.

4. The stakedown assembly according to claim 1 wherein said drive motor is a hydraulic cylinder.

5. The stakedown assembly according to claim 4 wherein said hydraulic cylinder is further connected to said support member.

6. A stakedown assembly for a horizontal directional drill comprising:

a) a tower;

b) a gear rack fixedly attached to said tower;

c) a drive head connected to said tower to allow longitudinal movement thereon;

d) a gear rack fixedly attached to said drive head;

e) a gear pinion installed between said tower gear rack and said drive head gear rack; and f) driving means pivotally connected to said gear pinion.

7. The stakedown assembly according to claim 6 wherein said tower is rotatably mounted in said stakedown assembly.

8. The stakedown assembly according to claim 6 wherein said driving means is a hydraulic cylinder.

9. The stakedown assembly according to claim 8 wherein the range of travel of said pinion is greater than fifteen inches.

10. The stakedown assembly according to claim 8 wherein the range of travel of said pinion is less than twenty inches.

11. The stakedown assembly according to claim 8 wherein a clevis is attached to one end of said hydraulic cylinder, a pivot pin being installed through said gear pinion, the clevis being further attached to ends of the pivot pin that extend beyond the gear pinion.

12. The stakedown assembly according to claim 11 wherein a roller is provided between said tower and said drive head to provide a minimum adequate spacing between said fixed gear rack and said moving gear rack.

13. The stakedown assembly according to claim 12 wherein shims are provided to provide a maximum adequate spacing between said fixed gear rack and said moving gear rack.

* * * * *